United States Patent [19]

Sekiguchi et al.

[11] 4,360,280

[45] Nov. 23, 1982

[54] MECHANICAL PENCIL HAVING A LEAD DETECTOR

[75] Inventors: Tomozo Sekiguchi, Soka; Junichi Hashimoto, Saitama, both of Japan

[73] Assignee: Pentel Kabushiki Kaisha, Japan

[21] Appl. No.: 149,562

[22] Filed: May 14, 1980

[30] Foreign Application Priority Data

May 15, 1979 [JP] Japan ..... 54-64345[U]

[51] Int. Cl.[3] ..... B43K 29/00

[52] U.S. Cl. ..... 401/194; 401/65

[58] Field of Search ..... 340/321, 691, 568; 401/194, 195; 400/708, 708.1

[56] References Cited

U.S. PATENT DOCUMENTS

| | | | |
|---|---|---|---|
| 1,365,463 | 1/1921 | Dahlberg | 401/194 |
| 1,409,613 | 3/1922 | Strasser | 401/194 |
| 2,095,091 | 10/1937 | Back | 401/194 |
| 2,236,683 | 4/1941 | Gudge | 401/194 |
| 2,474,951 | 7/1949 | McCoy, Jr. | 400/708.1 |
| 2,961,999 | 11/1960 | Torchi | 401/194 |
| 3,045,111 | 7/1962 | Hoenig | 401/195 |
| 3,121,286 | 2/1964 | Schneiderman | 340/321 |
| 3,537,799 | 11/1970 | Sakamoto | 401/67 |
| 3,963,914 | 6/1976 | Browning et al. | 401/195 |

*Primary Examiner*—William Pieprz

*Attorney, Agent, or Firm*—Robert E. Burns; Emmanuel J. Lobato; Bruce L. Adams

[57] ABSTRACT

A mechanical pencil of knocking operated type includes an electrical indicator which provides a visible or audible indication of the presence or absence of a writing lead in the mechanical pencil. A power supply in the form of a cell or storage battery is loaded into a pen body. A first and a second channel are provided which electrically connect the power supply with the indicator. The first channel is associated with one of the poles of the power supply, and is formed by a collet chuck and a lead guide sleeve which are disposed within the pen body in spaced relationship from each other. The second channel is associated with the other pole of the power supply, and includes a switch which is operated in response to a knocking operation which drives the collet chuck. When a writing lead is present between the collet chuck and the lead guide sleeve, the both members are electrically connected together through the lead, whereby the first channel is rendered conductive. The second channel is rendered conductive when the switch is turned on in response to the knocking operation. Consequently, if any remaining lead is available, the indicator is operated each time the knocking operation takes place, but when the final lead is consumed to a degree that it is removed from the collet chuck, the knocking operation can not operate the indicator.

9 Claims, 2 Drawing Figures

MECHANICAL PENCIL HAVING A LEAD DETECTOR

FIELD OF THE INVENTION

The invention relates to a mechanical pencil of the type in which successive lengths of a writing lead are fed from a stowage housing in response to a knocking operation, and more paticularly, to a detector which provides a visible or audible indication of the presence or absence of a lead or leads within the mechanical pencil.

DESCRIPTION OF THE PRIOR ART

There has been proposed a mechanical pencil including a body which is formed of a transparent synthetic resin together with a stowage housing in order to permit a visible recognition of a spare supply of leads in the stowage housing however, this approach has been unsuccessful for the obvious reason that the internal wall of the stowage housing becomes marred by the leads. On the other hand, there has been an attempt to permit such recognition through a small slit formed in the bottom of the stowage housing. In this instance, the slit must be small enough to prevent a withdrawal of a lead therethrough, and this presented a difficulty in affording direct recognition of a lead or leads. Another proposal has been made in which a colored indicator in the form of a piston is slidably received in the stowage housing and is adapted to move down gradually as the final lead is consumed, thereby allowing a recognition through a slit. However this again suffered from the disadvantage that both the stowage housing and the indicator must be manufactured with a close tolerance since otherwise a smooth sliding motion of the indicator within the stowage housing cannot be obtained. Also, in use, when replenishing a spare supply of leads into the stowage housing, the indicator must be withdrawn first before the leads can be inserted, and then must be reloaded. Another difficulty with this arrangement is that if the indicator is loose within the stowage housing, the indicator may cause a breakage of the remaining lead or leads whenever an impact is applied thereto. Thus it will be seen that there has been no means available heretofore which adequately detects the final lead within the mechanical pencil.

SUMMARY OF THE INVENTION

It is an object of the invention to provide a mechanical pencil having a lead detector which provides a visible or audible indication of the absence of a spare writing lead within a stowage housing before the final lead is consumed.

It is a specific object of the invention to provide a lead detector which provides an indication of the presence or absence of any remaining lead within a mechanical pencil in response to a knocking operation thereof and only during such operation.

In accordance with the invention, there is provided a mechanical pencil including a hollow cylindrical pen body, a ferrule member connected to one end of the pen body and having a lead guide sleeve in alignment with the axis of the pencil body, a lead stowage housing disposed within the pencil body and having its one end which is located at the other end of the pencil body to be capable of being opened, a lead feeder mounted within the pencil body and including a collet chuck connected to the other end of the lead stowage housing, and operating means for driving the collet chuck so that a writing lead in the lead stowage housing can be fed to the exterior through the lead guide sleeve. The mechanical pencil further comprises a power supply in the form of a cell or storage battery is received within the pencil body, an electrical indicator adapted to be energized from the power supply, and means for providing an electrical interconnection between the power supply and the indicator, the interconnecting means including a first channel associated with one pole of the power supply and extending through the collet chuck and the lead guide sleeve and also including a second channel associated with the other pole of the power supply and including a switch which is operated in association with the operating means, the first channel being rendered conductive through a writing lead whenever the writing lead is engaged with both the collet chuck and the lead guide sleeve, the second channel being rendered conductive through the switch whenever the operating means is actuated, the indicator becoming operative in response to the conduction of the first and the second channel.

The principle of the invention is applicable to a variety of mechanical pencils of the knocking operated type. Such mechanical pencils may include a knocking member which may be mounted either at the rear end, on the lateral side or on the front end of the pencil. The term "front end" or "front" or the term "rear end" or "rear" refers to a position as referenced to the writing tip of the mechanical pencil. A mechanical pencil which is adapted to be knocked or actuated at its rear end is shown and described in detail in connection with the preferred embodiment to be described later while those mechanical pencils which are adapted to be knocked from the side or at the front end are disclosed in U.S. Pat. No. 3,892,495 and U.S. Pat. No. 3,424,535.

The electrical indicator used in the present invention preferably comprises a light emitting diode or an electronic buzzer. A miniature buzzer of either electromagnetic or piezoelectric type which is provided with an electronic oscillator circuit, such as those used in a watch, may be preferably used. However, the use of other visible or audible indicators may be used.

DESCRIPTION OF PREFERRED EMBODIMENT

Figure 1:
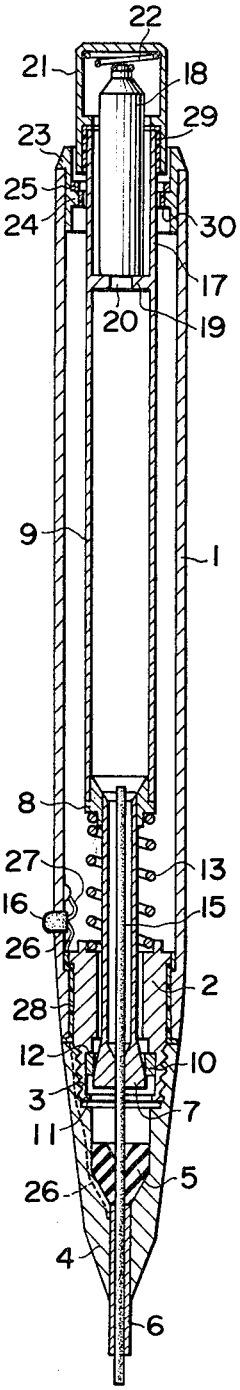
FIG. 1 is a longitudinal section of a mechanical pencil according to the invention.

Referring to FIG. 1, the mechanical pencil of the invention includes a hollow cylindrical pencil body 1, and a connecting block 2 firmly fitted into the front end or the lower end, as viewed in FIG. 1, of the pencil body. The connecting block 2 is cylindrical and has its one end formed as a screw 3 which projects forwardly from the pencil body 1. A funnel-shaped ferrule member 4 is threadably engaged with the screw 3, and carries a lead holding member 5 formed of a resilient material which is disposed in alignment with the axis of the pencil body 1, and a lead guide sleeve 6 which communicates with the holding member 5. Mounted within the pencil body 1 is a lead feeder including a collet chuck 7 of a known form, the rear end, or the upper end, as viewed in FIG. 1, of which is connected through a fixture 8 to one end of a cylindrical lead stowage housing 9. The collet chuck 7 is well known and hence will not be described in detail. However, it will be noted that it cooperates with a control ring 10 which is slidable in the axial direction of the connecting block 2. The connecting block 2 is provided with a pair of axially spaced stops 11, 12 which define a predetermined stroke for the control ring 10. A coiled biasing spring 13 is disposed between the connecting block 2 and the fixture 8 to urge the collet chuck 7 rearwardly together with the lead stowage housing 9, whereby the control ring 10 follows the movement of the collet chuck 7 to assume its rear position where it engages the rear stop 12 of the connecting block 2 and where the collet chuck 7 is clamped by the control ring 10. Consequently, when a writing lead 15 is present in the collet chuck 7, it is firmly held by the chuck. When the collet chuck 7 is driven forward against the resilience of the biasing spring 13, it moves forward while being clamped by the control ring 10, thus feeding the lead 15 forward. This movement continues until the control ring 10 abuts against the front stop 11 on the connecting block 2, whereupon the collet chuck 7 is released from a clamping action by the control ring 10 to release the lead 15. When the forward drive to the collet chuck 7 is removed, the spring 13 returns it to its normal position together with the control ring 10. At this time, the lead 15 is gripped by the lead holding member 5 and hence remains at its forward position. A feeding operation of the lead 15 is completed in this manner.

Figure 2:
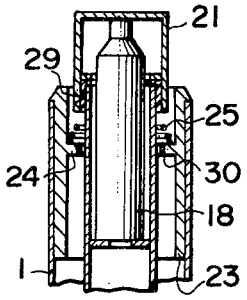
FIG. 2 is a fragmentary enlarged view thereof.

The pencil body 1 is provided with an electrical indicator 16 which is shown as a light emitting diode in the illustrated embodiment for the convenience of description. A power supply housing 17 is mounted on the rear end of the stowage housing 9 in coaxial relationship, and houses a replaceable cell or storage battery 18 which is utilized to energize the indicator 16. Formed intermediate the stowage housing 9 and the power supply housing 17 is a partition wall 19 which contacts one of the poles of the power supply 18 and which is formed with an opening 20 which may be utilized to load a supply of writing leads 15 into the stowage housing 9. A cylindrical cap 21 is detachably mounted on the supply housing 17 and projects from the rear end of the pencil body 1. A spring 22 which engages the other pole of the supply 16 is received within the cap 21. A cylindrical rear member 23 is firmly fitted in the rear end of the pencil body 1 and includes an inwardly extending annular rib 24. Referring to FIG. 2 together with FIG. 1, it will be seen that an electrically conductive rubber or conductive spring 25 is mounted on the annular rib 24. The cap 21 has its edge located within the rear menber 23 so as to be spaced from both the wall surface of the rear member 23 and the spring 25 on the annular rib 24. As the cap 21 is knocked or pushed forward, the collet chuck 7 is driven forward against the resilience of the spring 13, together with the supply housing 17 which is connected to the cap 21 as well as the lead stowage housing 9, thereby performing a feeding operation of the lead 15. During the feeding operation, the edge of the cap 21 bears against the annular rib 24 of the rear member 23.

In order to form a pair of electrical channels which define a closed electric circuit loop between the power supply 18 and the indicator 16, components which constitute the first channel associated with one pole of the power supply 18 and including the partition wall 19, the stowage housing 9, the fixture 8, the collet chuck 7 and the guide sleeve 6 as well as components which constitute the second channel associated with the other pole of the supply 18 and including the cap 21, the spring 22, the rear member 23 and the pen body 1 are formed of electrically conductive materials. The indicator 16 includes a pair of lead wires 26, 27 which are electrically connected to the guide sleeve 6 and the pen body 1. To provide an electrical insulation between both channels, a cylindrical insulator 28 is inserted between the pen body 1 and the connecting block 2 while the cap 21 and the annular rib 24 are provided with insulating liners 29, 30, respectively. The lead wire 26 which couples the guide sleeve 6 with the indicator 16 is shown in dotted lines for the convenience of illustration, but it may be passed through a slit, not shown, formed in the guide sleeve 6.

In operation, when the cap 21 is pushed in a usual manner, the supply housing 17 connected therewith moves forward together with the stowage housing 9 and the collet chuck 7, whereby the lead 15 is fed forward. If the lead 15 is engaged with both the collet chuck 7 and the guide sleeve 6, the first channel is completed through the electrically conductive lead 15. Specifically, the writing lead 15 is a good electrical conductor including a large quantity of carbon, so it forms an electrical coupling between the collet chuck 7 and the guide sleeve 6. As the cap 21 is pushed forward, its edge will be moved into contact with the spring 25 disposed within the rear member 23, whereby the second channel is also completed. As a result, a closed electric circuit loop is formed between the supply 18 and the indicator 16, thus operating the indicator 16. In this instance, the cap 21 comprises a movable contact member and the conductive spring 25 inside in conjunction with the rear member 23 comprise a stationary contact member. The movable and stationary contact members act as a switch which operates in response to a knocking operation of the cap 21. When the cap 21 is pushed further forward, the collet chuck 7 is released from a clamping action by the control ring 10, whereby the lead 15 is released from the collet chuck 7. Subsequently, when the cap is released, the collet chuck 7 will again grip the lead 15, but as the cap 21 returns to its original position, the edge of the cap 21 will no longer be in contact with the spring 25 inside the rear member 23, thus disconnecting the second channel. So long as a spare supply of leads 15 is present in the stowage housing 9, the leads 15 will be sequentially supplied from the housing 9 in end-to-end relationship and leads will make end-to-end electrical contact, so that the described operation is repeated for each knocking operation. However, when the final lead is released from the collet chuck 7, no electrical coupling is achieved between the collet chuck 7 and the guide sleeve 6 in response to a knocking operation, and hence the first channel cannot be rendered conductive. Accordingly, the failure of the indicator 16 to operate during a knocking operation provides an indication that the final lead is near exhaustion.

While the invention has been described above in connection with a preferred embodiment, it should be understood that the above description is illustrative only, and not limitative of the invention. In particular, the indicator in the form of the light emitting diode may be replaced by a miniature buzzer which is provided with an electronic oscillator circuit. In addition, the location where such indicator is provided is not limited to the side of the pencil body, but it may be located within the cap at the rear end of the pencil body. While in the embodiment described above, the pencil body is formed of a conductive material since it is utilized as part of an electrical channel, it may be formed of a synthetic resin material, if desired, with a conductive strip applied to the interior surface thereof.

What is clamed is:

1. A mechanical pencil including a hollow cylindrical pencil body, a ferrule member connected to one end of the pencil body and carrying a lead guide sleeve in alignment with the axis of the pencil body, a cylindrical lead stowage housing disposed within the pencil body and having one end located at the other end of the pencil body and capable of being opened, a lead feeder mounted in the pencil body and connected to the other end of the lead stowage housing and including a collet chuck which is supported to be movable in the axial direction of the pencil body together with the lead stowage housing, operating means for driving the collet chuck axially of the pencil body in order to feed a writing lead contained in the stowage housing to the exterior thereof through the guide sleeve, a power supply in the form of a cell or storage battery contained in the pencil body, an electrical indicator adapted to be energized from the power supply, and means for providing an electrical interconnection between the power supply and the indicator, the interconnection means including a first channel associated with one of the poles of the power supply and including the collet chuck and the lead guide sleeve, both of which are formed of an electrically conductive material and also including a second channel associated with the other pole of the power supply and including a switch which is operated in response to an operation of the operating means, the first channel being rendered conductive through a writing lead whenever the writing lead is engaged with both the collet chuck and the lead guide sleeve, the second channel being rendered conductive through the switch whenever the operating means is actuated, the indicator being operated in response to the conduction of both the first and the second channel.

2. A mechanical pencil according to claim 1, further comprising a power supply housing connected to said one end of the lead stowage housing in coaxial relationship therewith, a cylindrical cap detachably mounted on the power supply housing, and a cylindrical rear member firmly fitted in the other end of the pencil body and internally housing a spring member which is dislosed in spaced, opposing relationship with the edge of the cap, the lead stowage housing, the cap and the spring being formed of electrically conductive materials, the power supply being disposed in the power supply housing and having its one pole electrically connected to the stowage housing and its other pole electrically connected to the cap, the switch being formed by the combination of the cap and the spring.

3. In the mechanical pencil: an elongate pencil body; a stowage housing mounted to undergo longitudinal movement within the pencil body for storing a supply of electrically conductive pencil leads; lead-feeding means including a collet chuck mounted within the pencil body and coacting with the stowage housing for successively gripping and feeding pencil leads to the exterior of one end of the pencil body in response to longitudinal movement of the stowage housing in one direction; and indicating means for indicating when the last one of the supply of pencil leads nears exhaustion, said indicating means comprising an electrically energizeable indicator exhibiting a first indication state when energized and a second indication state when deenergized, a replaceable electric power supply, means defining a normally open electric circuit electrically connecting the power supply to the indicator, said electric circuit including as a conductive part thereof one of the electrically conductive pencil leads gripped by the collet chuck, and normally open actuatable switch means connected in the electric circuit and operative when actuated to effect closing of the electric circuit when a pencil lead is gripped by the collet chuck to thereby effect energization of the indicator to said first indication state and to not effect closing of the electric circuit when no pencil lead is gripped by the collet chuck whereby the indicator remains deenergized and in said second indication state to thereby indicate that the last one of the supply of pencil leads is near exhaustion.

4. A mechanical pencil according to claim 3; wherein said switch means is disposed at the other end of the pencil body and comprises a stationary contact member connected in the electric circuit, a movable contact member mounted for manual amovement into and out of contact with the stationary contact member, and biasing means biasing the movable contact member, whereby depression of the movable contact member against the force exerted by the biasing means effects movement of the movable contact member into contact with the stationary contact member to thereby actuate the switch means.

5. A mechanical pencil according to claim 4; including an electrically conductive spring disposed between the movable and stationary contact members.

6. A mechanical pencil according to claim 4; including an electrically conductive rubber disposed between the movable and stationary contact members.

7. A mechanical pencil according to claim 3; wherein the pencil body is composed of electrically conductive material and comprises part of the electric circuit which electrically connects the power supply to the indicator.

8. A mechanical pencil according to claim 3; wherein the indicator comprises a light emitting diode.

9. A mechanical pencil according to any of claims 3, 4 or 7; including means connecting the switch means to the stowage housing such that each actuation of the switch means effects longitudinal movement of the stowage housing in said one direction.

* * * * *